US006412624B1

(12) United States Patent
Lundin

(10) Patent No.: US 6,412,624 B1
(45) Date of Patent: Jul. 2, 2002

(54) CASSETTE FOR PACKAGING CONTAINERS

(75) Inventor: Olof Lundin, Staffanstorp (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/582,723

(22) PCT Filed: Dec. 16, 1998

(86) PCT No.: PCT/SE98/02342

§ 371 (c)(1),
(2), (4) Date: Jun. 30, 2000

(87) PCT Pub. No.: WO99/36323

PCT Pub. Date: Jul. 22, 1999

(30) Foreign Application Priority Data

Jan. 14, 1998 (SE) ..... 980060

(51) Int. Cl.[7] ..... A45F 5/10
(52) U.S. Cl. ..... 198/803.14; 198/867.11
(58) Field of Search ..... 198/803.14, 803.15, 198/867.11, 867.12

(56) References Cited

U.S. PATENT DOCUMENTS 3,675,759 A * 7/1972 Koppe ..... 198/803.14

FOREIGN PATENT DOCUMENTS

| | | | |
|---|---|---|---|
| DE | 29 00 714 | | 7/1980 |
| EP | 0 615 909 | | 9/1994 |
| GB | 2128077 | * | 4/1984 |

* cited by examiner

*Primary Examiner*—Matthew C. Graham
(74) *Attorney, Agent, or Firm*—Burns, Doane, Swecker & Mathis, L.L.P.

(57) ABSTRACT

The disclosure relates to a cassette for packaging containers of the type which is of flexible material and substantially parallelepipedic configuration. The cassette includes a through-going channel (2) open at both ends for the packaging container (3), the channel (2) displaying mechanical support members (15) in the form of support surfaces (17) which are disposed to cooperate with the flexible comer flaps (9) of the packaging container (3), the lower ends of the comer flaps snapping out towards and coming to rest against the support surface (17) so that the packaging container is held in the correct position in the cassette (1).

7 Claims, 1 Drawing Sheet

CASSETTE FOR PACKAGING CONTAINERS

TECHNICAL FIELD

The present invention relates to a cassette for packaging containers of flexible material, the cassette having two opposing walls.

BACKGROUND ART

Packaging containers for consumer products, and in particular foods such as dairy products, creams or purees are often manufactured from flexible material which is cut, folded and thermosealed to form a finished packaging container, for example of parallelepipedic configuration. One type of packaging container which at present is available on the market is thus manufactured from a flexible packaging laminate which includes a carrier or core layer of fibre material (paper) which, on either side, is coated with layers of thermoplastic material, e.g. polyethylene or some type of plastic. The packaging laminate also often includes barrier layers of metal (aluminium foil) or plastic material in order to ensure that the packaging container receives the desired gas- and bacteria tightness.

A plurality of different filling machines for manufacturing these or similar types of packaging containers are known in the art. Many of these operate with semi-manufactures, e.g. tubular packaging container blanks, which are fed into the machine in the flat-laid state, but are erected so as to obtain a preferably square or rectangular cross section when they are fed into the filling machine. During movement through the filling machine, the packaging containers are progressively provided with a liquid-tight bottom which may be in the form of a separate bottom portion which is connected to the tubular packaging container portion or constitutes a part of the packaging container separated off by means of crease lines, this part being folded and thermosealed for the formation of a liquid-tight bottom. The packaging container is thereafter moved on to a filling station in which the desired type of contents are filled into the packaging container, whereafter its as yet open end is closed and sealed. This may take place by means of a separate portion or in that this packaging container end is also provided with end wall panels which are separated by means of crease lines and which are folded together and sealed for the formation of a tight packaging container end wall. The packaging container may possibly be provided with some form of opening arrangement and, after application of this opening arrangement, and possible final forming, the filled packaging container is finished and discharged from the filling machine.

Each individual packaging container which is moved through a filling machine of this type is preferably carried by some form of conveyor which ensures that the packaging containers are displaced between different stations for bottom forming, filling and top forming. In its simplest form, the conveyor may consist of a standard conveyor belt with some form of carriers, e.g. strips or fingers. In more sophisticated filling machines operating at high speed and with rapid accelerations, it is, however, of vital importance that the individual packaging containers be both placed and maintained in the correct position for the different operational phases, for example end closure and filling, and increasingly stringent demands are therefore being placed on the ability of the conveyor to move the individual packaging containers from station to station with precision and rapidity. It is, therefore, now common that each individual packaging container is supported by a cassette which, on at least two sides, surrounds the packaging container and fixes it in an accurately predetermined position in relation to the conveyor and the different stations.

Apart from the accurate positioning of each individual packaging container in the longitudinal and transverse directions of the conveyor, it is, in particular in mechanical processing, for example bottom or top sealing of the packaging container, also of major importance that the vertical position of the packaging container be accurately defined when it is located on the conveyor. This takes place in prior art conveyors normally in that each cassette is provided with a bottom against which the lower end of the packaging container rests, or in that the lower end of the cassette is open so that the lower end of the packaging container can rest on stationary guides or sliding surfaces. Both of these systems suffer from a number of drawbacks.

In prior art conveyors of the type which includes cassettes with a fixed or movable bottom, this will limit accessibility to the end of the packaging container facing towards the bottom and it will thus become necessary to carry out any possible processing phases already before the packaging container is placed in the cassette. Insertion and removal, respectively, of the packaging container in the cassette must also take place from above or from the side, since the cassette bottom prevents insertion of the packaging container from the lower end of the cassette. In packaging containers of the type in which the bottom is formed by folding, forming and sealing of end wall panels defined by means of crease lines on the packaging container, the configuration of the bottom will, moreover, not be so well defined, with the result that the surface which abuts against the bottom of the cassette may have a physical form which varies within certain limits. This entails that the vertical position of the packaging container in the cassette may vary such that its upper end may be located a few millimetres higher or lower than the desired position, which is of particularly serious disadvantage when end wall panels at the upper end of the packaging container are to be folded and sealed for the formation of the upper end wall of the packaging container.

In the type of conveyors which include cassettes without a bottom surface, a packaging container placed in the cassette will instead slide with its lower end against stationary guides or surfaces, which makes it possible to access the lower end of the packaging container, for example for bottom formation or other processing while the packaging container is located in the conveyor. However, this sliding against such sliding surfaces entails a certain friction which, in long transport distances and/ or fragile packaging material, may result in damage, for example that the liquid-tight surface layer or the artwork decor on the outside of the packaging container is exposed to wear which negatively affects the performance or appearance of the finished packaging container. If the packaging container, as is often the case, is placed inverted in the cassette in order to make for filling at the bottom end of the packaging container, the downwardly facing top end of the packaging container is often provided with some type of projecting opening arrangement, for example a lid of plastic material which, in such an event, is subjected to unnecessary wear which, while not in itself damaging or affecting the function of the opening arrangement, may result in the opening arrangement having a worn or distressed appearance. Also in that type of packaging conveyor which includes fixed guides or sliding surfaces, the placing of the packaging container in the vertical direction may be slightly varying, which entails the previously mentioned drawbacks on processing of the opposite, temporarily upper end of the packaging container. There is also a risk that the sliding surface or guides accumulate impurities or scrapings from the packaging paperboard which then adhere to a part of the outsides of the finished packaging containers.

There is thus a general need in the art to realise a cassette by means of which a packaging container of flexible material may be transported through a filling machine in a reliable and accurately fixed manner without the above-outlined drawbacks occurring.

OBJECTS OF THE INVENTION

One object of the present invention is therefore to realise a cassette for packaging containers, the cassette being constructed such that it is simple to insert and remove packaging containers and that a packaging container placed in the cassette will be reliably fixed in the correct position and with the correct orientation.

A further object of the present invention is to realise a cassette for employment in a per se known conveyor in a filling machine, the cassette making it possible to transport packaging containers between different processing stations in the filling machine without the packaging containers being subjected to unnecessary wear or other damage.

Yet a further object of the present invention is to realise a cassette by means of which a packaging container of flexible material may be fixed in the desired position for displacement through a filling machine without parts projecting from the packaging container being subjected to damage.

Still a further object of the present invention is finally to realise a cassette for packaging containers of flexible material, the cassette being of simple design and construction and lacking moving parts, rendering it therefore operationally reliable and easy to clean.

SOLUTION

The above and other objects have been attained according to the present invention in that a cassette for packaging containers of flexible material, the cassette having two opposing walls, has been given the characterizing feature that the walls are located in mutual spaced apart relationship a distance corresponding to the corresponding external dimensions of the packaging container, the cassette including a support member for fixing the packaging container in the correct position in the cassette by cooperation with a flexible portion projecting from the packaging container.

Preferred embodiments of the apparatus according to the present invention have further been given the characterizing features as set forth in the appended subclaims.

By designing, according to the present invention, the cassette with one or more fixed, integrated support device which utilises the flexibility of the packaging container in order to fix the packaging container in the correct position, a complicated design and construction which is difficult to wash and clean may be avoided, at the same time as the cassette has an open construction which makes it possible to move the packaging container into or out of the cassette at both ends thereof

BRIEF DESCRIPTION OF THE ACCOMPANYING DRAWING

One preferred embodiment of a cassette according to the present invention will now be described in greater detail hereinbelow, with particular reference to the accompanying, schematic Drawing which shows only those parts and details indispensable to an understanding of the present invention. In the accompanying Drawing.

DESCRIPTION OF PREFERRED EMBODIMENT

The apparatus according to the present invention is principally intended for conveying packaging containers or packaging container blanks (only the term "packaging container(s)" will be used hereafter, but is understood that packaging containers or packaging container blanks at various stages of manufacture or forming are encompassed by this term). In a filling machine of the type in which an endless conveyor moves packaging containers between different processing stations (e.g. an infeed station, a bottom forming station, a filling station and a top sealing station), each individual container is normally displaced stepwise between the different stations and it is, therefore, of crucial importance that the packaging container is placed with high precision in the correct position in the station so that processing may take place correctly. A filling machine of this main type is disclosed in, for example, European Patent Application 94101370.8, to which reference is now made for further information concerning the filling machine and its design and construction. Naturally, the apparatus according to the present invention may also be employed in other contexts, for example in any such handling of packaging containers as requires that these be placed in some form of cassette or holder. The apparatus according to the present invention is further intended for the per se known type of flexible packaging container which includes projecting, resiliently yieldable or flexible parts, for example folded or unfolded corner flaps, projecting packaging container corners or other parts. Preferably, the apparatus is intended for a packaging container which is manufactured from a flexible packaging laminate which includes a layer of a core or carrier material, for example paper, which is coated on either side with layers of thermoplastic material, for example polyethylene or polypropylene. A typical packaging container of this type is marketed under the trademark Tetra Brik®, but other, similar types of packaging containers may naturally be handled using the apparatus according to the present invention.

Figure 1:
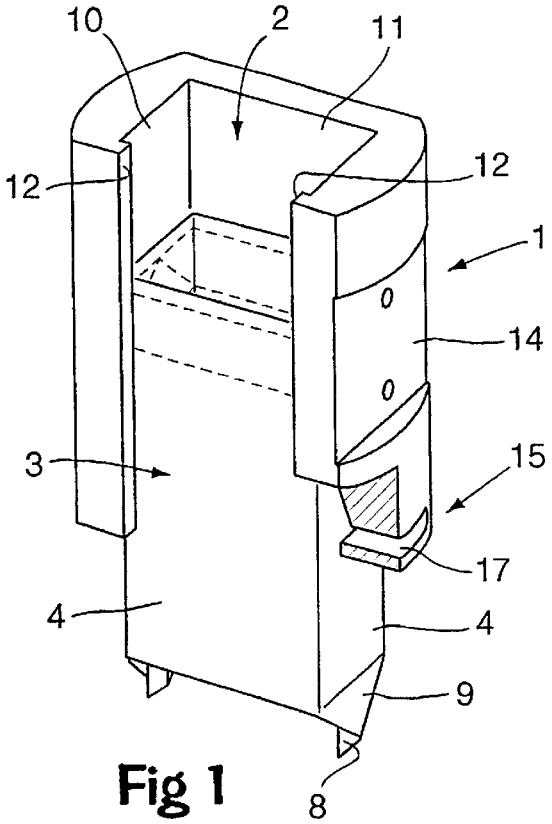
FIG. 1 is a perspective view, partly in section, of a cassette according to the present invention during the infeed of a packaging container from beneath.
Figure 2:
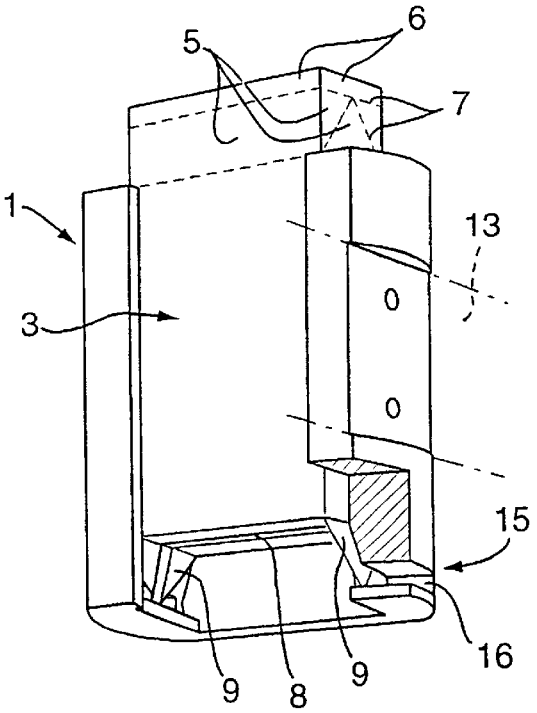
FIG. 2 shows the cassette according to FIG. 1 with the packaging container in the fixed position.
Figure 3:
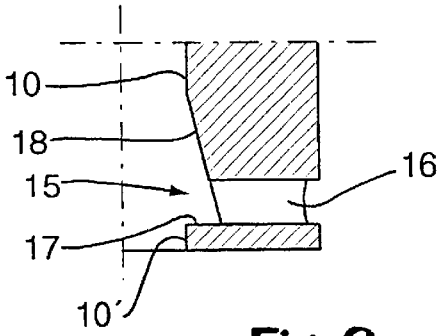
FIG. 3 shows a section through a part the cassette according to the present invention in which a support device is provided.

The preferred embodiment of the apparatus according to the present invention shown in the Figures comprises a cassette 1 which has a vertically extending channel 2 which is designed for accommodating a packaging container 3 of known, preferably parallelepipedic type. The packaging container 3 has four side wall panels 4 which together give the packaging container a substantially rectangular cross section. At the upper and lower ends of the side wall panels 4, there are connected rectangular and triangular end wall panels 5, as well as transverse joint panels 6 which, in a per se known manner, are discrete from one another by means of a number of crease lines 7 so that these panels, by mechanical processing (folding) and sealing, can be formed into substantially planar end walls. In such instance, a transverse sealing fin or transverse joint 8 is created (formed by the transverse joint panels 6) and extends over both the end wall of the packaging container and flexible parts or corner flaps 9 projecting therefrom which are formed by the triangular end wall panels 5. One or more of the flexible, projecting parts or corner flaps 9 which are located at the lower end of the packaging container 3 in FIGS. 1 and 2 are utilised for fixing the packaging container in the correct position in the cassette 1. In the finished packaging container, the corner flaps 9 are folded down towards and sealed to the side wall panels 4 of the packaging container, but also in this position the end portions of the flexible flaps 9 are free and capable of being utilised for fixing in the channel 2 of the cassette 1. In this instance, use is instead preferably made of both of the upper corner flaps, and the form of the cassette is adapted correspondingly. This feature will be described in greater detail below.

As was previously mentioned, the cassette 1 has a recess in the form of, for example, a through-going channel 2 around which the cassette 1 extends, in the illustrated embodiment, in substantially U-shape. The channel 2, whose cross section substantially corresponds with the cross section of the packaging container 3, is thus defined by two opposing walls which are mutually parallel and disposed at a right angle to a third wall 11. Opposite the wall 11, the cassette 1 has an open portion which is defined by two narrow wall portions or guides 12 which project from the edges of the walls 10 facing away from the wall 11 and together define an opening in the U-shaped cassette 1, this opening being narrower than the corresponding width dimension of the packaging container 3. Hereby, a packaging container 3 located in the channel 2 is retained in the cassette 1 despite its open side. The walls 10 are located in such mutual spaced apart relationship that this distance substantially corresponds to the external dimensions of the packaging container 3. Similarly, the distance between the wall 11 and the surfaces of the guides 12 facing towards the wall 11 is such that the packaging container 3 may be displaced with sliding fit upwards or downwards in the channel 2. This sliding fit is normally sufficient for the inherently light packaging container 3 to be retained in the unfilled state in the desired position in the cassette 1. In packaging containers with non-parallel (e.g. inclined) side wall panels, both opposing walls 10 of the cassette 1 are adapted so as to assume a corresponding inclination. Naturally, the design and slope of the walls can also be adapted to other possible package configurations, for example hexagonal or octagonal, truncated pyramid or frusto-conical shaped packaging containers.

When the cassette, as previously mentioned, is employed in order, together with an endless conveyor, to move packaging containers 3 between different stations in a filling machine, a number of cassettes 1 are mechanically interconnected to an endless conveyor 13, which is indicated by ghosted lines in FIG. 2. The cassettes 1 are, for this reason, provided with a planar mounting surface 14 as well as suitable devices for making possible mounting on the conveyor belt or chain (not shown) of the conveyor 13.

In order to ensure that the packaging container 3 is retained in the cassette 1 also in connection with, for example, a filling operation, a forming processing operation or a sealing operation, the cassette 1 according to the present invention is provided with at least one and preferably two support members 15 which are located at each respective lower end of the two opposing walls 10. Each support member includes a recess or groove 16 which extends transversely through the cassette wall and whose lower end facing towards the channel 2 is designed with a support surface 17 which extends substantially at a right angle to the centre axis of the cassette 1, i.e. an axis of symmetry (not shown) vertically extending, in FIGS. 1 and 2, centrally through the channel 2. Thus, the support members are permanently formed in the wall of the cassette and are thereby immobile in relation to the cassette 1. The support members are intended, by mechanical cooperation with flexible parts on the packaging container 3, to ensure that this is held in the correct position in the cassette 1, more precisely in the correct vertical position in the channel 2. This is put into effect in that the projecting, flexible corner flaps 9 of the packaging containers are, at their lower end, caused to abut against the support surfaces 17. More precisely, the corner flaps 9 will, when the packaging container 3 is inserted from beneath in the channel 2 of the cassette 1, slide against the lower portion 10' of the wall surfaces 10 which is located beneath the grooves 16. When the lower ends of the corner flaps 9 (which coincide with both ends of the transverse joints 8) have passed the wall surface 10', the corner flaps will, because of the flexibility of the material and the rigidity of the transverse joint panel 6 or transverse joints 8, automatically snap outwards from the centre of the packaging container so that they partly enter into the grooves 16. This is facilitated by the fact the grooves 16 at their end facing towards the channel 2 display a bevelled, oblique entry surface 18, which extends obliquely upwards from the groove 16. Once the corner flaps 9 have finally passed the grooves 16 and come into abutment against the support surfaces 17, the packaging container 3 cannot thus once again be moved downwards through the channel 2. Removal of the packaging container 3 out of the channel 2 must therefore take place in that the packaging container is moved upwards in the cassette 1. By ensuring that the distance between the support surfaces 17 and the upper end of the cassette 1 corresponds to the distance from the outer free end of the corner flaps 9 and the upper edges of the side wall panels 4 defined by the crease lines 7, the packaging container 3 will, when it is located in the correct position in the cassette 1, be placed with the end wall panels 5 and transverse joint panels 6 above the upper end of the cassette 1, as is shown in FIG. 2. In this position, the packaging container 3 can now, with the aid of the cassette 1 and the conveyor 13, be moved to a filling station in which the desired contents are supplied through the open end of the packaging container. Thereafter, the packaging container is moved with the aid of the cassette to a final folding station in which, in a per se known manner, mechanical folding devices act on the end wall panels 5 and the transverse joint panels 6 so that the packaging container is provided with a substantially planar end wall. In a per se known manner, sealing of the end wall takes place with the aid of, for example, hot air which heats the outer, thermoplastic layer of the packaging laminate to melting temperature, whereafter the transverse joint panels 6 are compressed and allowed to cool so that a liquid-tight seal, forming the transverse joints 8, is created. The packaging container may thereafter be subjected to outer processing or be removed from the cassette 1 by being displaced upwards. This may be put into effect by means of a mechanical carrier finger (not shown), whose work is facilitated in that the channel 2 is open both downwards and upwards and, moreover, lacks one side wall. Once the packaging container 3 has been removed out of the cassette, it is also possible to finally form its lower end, i.e. to fold in the corner flaps 9 and seal them against the end wall of the packaging container. This operation may naturally also take place with the packaging container 3 partly remaining in place in the cassette 1, since it is possible, with the aid of compression devices or fingers, to act on the corner flaps 9 from outside via the grooves 16 so that the lower, free ends of these corner flaps are urged towards one another and in such instance slide off the support surfaces 17. The inward folding of the corner flaps 9 towards the bottom of the packaging container can possibly take place in the same operational phase, but it is also possible to move the packaging container downwards in the channel 2 so that suitable folding and sealing devices may, in a subsequent station, cater for the final forming and sealing of the bottom of the packaging container.

The placing of the support members 15 in both the vertical and lateral directions, as well as the design of the support members are of course adapted to suit the relevant packaging container type and dimensions. If, for example, a packaging container with inwardly folded corner flaps is to be handled, the support members are placed at the upper region of the cassette so that they can cooperate with the ends of the downwardly folded upper corner flaps abutting against the side wall panels 4. Correspondingly, the cassette may of course be adapted to any other type and size of flexible packaging container.

The design of the cassette 1 according to the present invention realises a reliable and simple construction which, without moving mechanical parts, ensures that a packaging container of the above-described or similar type is retained in a predetermined position in the cassette 1. Since no sliding surfaces or guides are needed to retain the packaging container 3 in the cassette 1 during movement of the cassette by means of the conveyor 13, the packaging containers will not be exposed to any wear, with the result that the outer plastic layer of the packaging container and any possible artwork decor layer may be chosen without needing to take into account any possible wear during transport of the packaging container through the filling machine. In addition, the absence of sliding surfaces and guides means that any possible corks, opening arrangements or other parts projecting from the packaging container do not run the risk of being damaged during transport of the packaging container through the filling machine. There is also space for processing the end walls of the packaging container when this is located in the cassette 1, for example the application of loose parts such as opening arrangements or the like. Naturally, the walls 10 of the cassette 1 may be provided with additional holes or recesses if this is suitable for increasing accessibility to the packaging container. The simple locking of the packaging container 3 in the cassette 1 makes it possible to design the cassette 1 in an extremely simple manner, which, thanks to the absence of moving parts and inaccessible pockets, is very easy to wash and keep clean, which is particularly advantageous in the employment of filling machines where a high standard of hygiene is necessary.

The present invention should not be considered as restricted to that described above and shown on the Drawing, many modifications being conceivable without departing from the scope of the appended Claims.

What is claimed is:

1. A cassette for packaging containers of flexible material, comprising:

two opposing walls located in mutually spaced apart relationship a distance corresponding to corresponding external dimensions of a packaging container to be supported, said two opposing walls defining a through-going channel accommodating the packaging container between the two opposing walls;

a support member for fixing the packaging container in the correct position in the cassette by cooperation with a flexible portion projecting from the packaging container, said support member including at least one recess in one of said two opposing walls.

2. The cassette as claimed in claim 1, wherein the support member is immobile in relation to the cassette.

3. The cassette as claimed in claim 1, wherein the support member includes a support surface.

4. The cassette as claimed in claim 3, wherein the support surface extends at a right angle to a center axis of the cassette.

5. The cassette as claimed in claim 1, characterized in that the walls (10) are parallel with the centre axis of the cassette (1).

6. The cassette as claimed in claim 1, further comprising a second support member located at the other of said two opposing walls in the cassette.

7. The cassette as claimed in claim 1, wherein the cassette has a U-shaped cross section.

* * * * *